US006536082B2

(12) United States Patent
Berrocal et al.

(10) Patent No.: US 6,536,082 B2
(45) Date of Patent: Mar. 25, 2003

(54) TAMPER-PROOF TIE

(75) Inventors: William G. Berrocal, Worcester, MA (US); James C. Benoit, Needham, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/927,083

(22) Filed: Aug. 9, 2001

(65) Prior Publication Data

US 2003/0029004 A1 Feb. 13, 2003

(51) Int. Cl.[7] ..... B65D 63/10

(52) U.S. Cl. ..... 24/16 PB; 24/16 R; 24/17 AP; 24/30.5 P; 24/637; 292/318; 292/321

(58) Field of Search ..... 24/16 PB, 16 R, 24/17 AP, 17 B, 30.5 P, 637, 200, 163 K, 71 J, 3.12; 292/318, 321

(56) References Cited

U.S. PATENT DOCUMENTS

| | | | | |
|---|---|---|---|---|
| 3,556,575 A | | 1/1971 | Farkas | |
| 3,712,655 A | | 1/1973 | Fuehrer | |
| 3,718,355 A | * | 2/1973 | Canter | 292/321 |
| 3,766,608 A | | 10/1973 | Fay | |
| 3,816,879 A | | 6/1974 | Merser et al. | |
| 3,881,759 A | * | 5/1975 | Fuehrer | 24/16 PB |
| 3,954,294 A | * | 5/1976 | Iwamoto et al. | 292/318 |
| 4,003,106 A | | 1/1977 | Schumacher et al. | |
| 4,059,300 A | * | 11/1977 | Moberg et al. | 24/16 PB |
| 4,240,183 A | | 12/1980 | Sumimoto et al. | |
| 4,347,648 A | | 9/1982 | Dekkers | |
| 4,588,218 A | * | 5/1986 | Guiler et al. | 24/16 PB |
| 4,609,218 A | * | 9/1986 | Chevillard et al. | 24/16 PB |
| 4,688,302 A | | 8/1987 | Caveney et al. | |
| 4,754,529 A | | 7/1988 | Paradis | |
| 4,946,210 A | * | 8/1990 | Fuehrer | 292/318 |
| 5,075,932 A | * | 12/1991 | Hunt et al. | 24/16 PB |
| 5,102,075 A | * | 4/1992 | Dyer | 24/16 PB |
| 5,364,141 A | * | 11/1994 | King | 292/318 |
| 5,636,412 A | | 6/1997 | Lodi et al. | |
| 5,685,048 A | | 11/1997 | Benoit | |
| 5,881,436 A | * | 3/1999 | Lyons | 24/16 R |
| 6,105,210 A | | 8/2000 | Benoit | |

FOREIGN PATENT DOCUMENTS

GB 2058194 8/1980

OTHER PUBLICATIONS

Brochure, Catamount Manufacturing Incorporated, Restricted Bundle Cable Tie, p. 7.

* cited by examiner

*Primary Examiner*—Victor Sakran
(74) *Attorney, Agent, or Firm*—Kriegsman & Kriegsman

(57) ABSTRACT

A tamper-proof tie includes a head and an attached strap. The head is shaped to define an elongated interior channel having a strap entry end and a strap exit end. The head includes an articulating locking tang disposed to project into the interior channel. The strap includes a first end formed onto the head, a second end and an anti-tampering device integrally formed onto the second end, the anti-tampering device including a plug and a finger. In use, the strap is inserted into the interior channel so the tie forms a closed loop. As the strap is inserted into the head, the locking tang engages the anti-tampering device to prevent withdrawal of the strap from the head. With the tie formed into a closed loop, the plug is sized and shaped to substantially enclose the entry end and the finger is sized and shaped to substantially enclose the exit end.

19 Claims, 15 Drawing Sheets

TAMPER-PROOF TIE

BACKGROUND OF THE INVENTION

The present invention relates generally to ties and, more particularly, to ties which can be formed into a closed loop.

Ties are well known in the art and are widely used in a variety of different applications.

One tie which is well known and widely used in the art is the cable tie. Cable ties are widely used in the art for bundling together of a plurality of objects, such as a group of wires.

One well known cable tie which is commonly used in commerce comprises a serrated strap which is fitted to an apertured head. In use, the cable tie can be formed into closed loop by inserting the serrated strap through the apertured head. With the serrated strap inserted through the apertured head, an internal pawl, or locking tang, disposed within the apertured head lockably engages the serrations of the strap to prevent the strap from being backed out of the apertured head. In this manner, the engagement of the internal pawl onto the serrated strap secures the cable tie in its closed loop configuration.

Another well known cable tie which is commonly used in commerce comprises an apertured, or ladder-type, strap which is fitted to a buckle-like head. In use, the cable tie can be formed into a closed loop by inserting the ladder-type strap through the buckle-like head. With the ladder strap inserted through the buckle head, a tongue, or internal pawl, disposed within the buckle head lockably engages the apertures of the strap to prevent the strap from being backed out of the head. In this manner, the engagement of the tongue into the apertures of the strap secures the cable tie in its closed loop configuration.

In U.S. Pat. No. 3,766,608 to Fay, which is incorporated herein by reference, there is disclosed a cable tie formed by a locking head and an attached ladder strap. The head contains a longitudinal guide channel for receiving the strap, after encirclement of items to be bundled, and an internal locking tang. The latter is deflected with respect to relatively narrow auxiliary channels on opposite sides of the guide channel. One of the auxiliary channels receives the locking tang during the bundling of the items; the other auxiliary channel contains a stop against which the locking tang becomes abutted in planar engagement by the reverse thrust of the harnessed items.

In U.S. Pat. No. 4,347,648 to Dekkers, which is incorporated herein by reference, there is disclosed a cable tie formed by a locking head and an attached ladder strap. The head contains a locking tang and a guide channel that receives the strap after encirclement of items to be bundled. The tang engages the rungs of the ladder strap for the adjustable retention of the items. The free end of the strap has a light-weight webbed tail that facilitates the insertion of the strap into the head. The strap is advantageously molded of a stretch reorientable material and is subsequently stretched to produce a suitable strengthening and elongation of the webbed tail.

Another tie which is well known and widely used in the art is the fixed-loop tie.

One well known fixed-loop tie which is commonly used in commerce comprises a strap, or fastener, which is fitted to a head. In use, the fixed-loop tie can be formed into a closed loop by inserting the strap into the head. The head is provided with an internal pawl or flange which lockably engages the strap to prevent the strap from being backed out of the head, thereby securing the tie in its closed loop configuration.

Fixed-loop ties differ from traditional cable ties in that fixed-loop ties are constructed in such a manner that the tie can only be formed into a limited range of closed loop sizes. In particular, the strap of a fixed-loop tie is commonly provided with an enlarged stop which limits the degree of advancement which the strap can be inserted into the head, thereby creating a minimum size closed loop into which the tie can be formed during use.

Fixed-loop ties are commonly used in a plurality of different applications.

As an example, fixed-loop ties are commonly used in the art to couple together two or more objects, fixed-loop ties which are utilized in this manner being commonly identified as merchandise pairing ties in the art. As can be appreciated, merchandise pairing ties are commonly used in the art to couple together a pair of shoes. In this capacity, merchandise pairing ties have been found to be not only a very useful device in displaying the pair of shoes for sale but also an effective device for preventing the theft of a single shoe, which is a common transgression.

To use a fixed-loop tie of the type described above to pair together a pair of shoes, the tail end of the strap is inserted through an eyelet or under the shoelace of each shoe. The tail is then inserted through a guide channel formed in the head so that the tie forms a closed loop. As the strap is further drawn forward through the guide channel of the head, the closed loop decreases in size. However, it should be noted that, increased insertion of the strap through the head will eventually cause the stop formed on the strap to abut against the head, thereby preventing further insertion of the strap into the head and limiting the size of the closed loop formed by the tie. As can be appreciated, because such a merchandise pairing tie has a substantially large minimum closed loop size, the shoes are ensured a substantial degree of separation which enables a prospective buyer the opportunity to comfortably try on and walk around in the shoes, which is highly desirable.

In U.S. Pat. No. 6,105,210 to J. C. Benoit, which issued on Aug. 22, 2000 and which is incorporated herein by reference, there is disclosed a merchandise pairing tie for use in pairing together two objects. The tie comprises a head having an elongated channel extending therethrough, a locking tang within the head, and a strap having a length of approximately 63.3 cm. The strap comprises a first end integrally formed onto the head and a second end. A projection is formed on the strap between the first end and the second end. The portion of the strap from the projection to the first end is in the form of an elongated, flexible filament having a length of approximately 59.5 cm. The elongated filament is narrow in thickness, narrow in width and has a generally uniform, rectangularly-shaped cross-section. In one embodiment, the portion of the strap from the projection to the second end is formed in a ladder structure having a plurality of rungs. The rungs of the strap are sequentially engaged by the locking tang when the strap is inserted into and through the elongated channel to form a closed loop. As the strap is further inserted through the elongated channel, the size of the closed loop is decreased. The projection serves as a stop to limit the minimum size of the closed loop which can be formed when the strap is inserted into the head.

As another example, fixed-loop ties are also commonly used in the art to secure the cover, or lid, of a box, or other similar container, in a closed position. In particular, fixed-loop ties of this type are often used to secure the cover of a tote box or other similar container for holding high-cost items, such as pharmaceuticals, electronics or food supplies, in a closed position during shipping. As such, the closed-loop tie acts as security device for preventing the theft of the items held within the container.

As another example, fixed-loop ties are also commonly used in the art to secure a ticket, or tag, onto an article of clothing. In particular, fixed-loop ties of this type are often used to secure a ski ticket, or pass, onto the jacket of a consumer. As such, the fixed-loop tie acts as a security device for preventing an unscrupulous consumer from removing the ski ticket from his/her jacket in order to enable another person to share in the use of the same ticket.

As another example, fixed-loop ties are also commonly used in the art as security seals. Specifically, security seals are commonly used to retain an item in its closed position. It should be noted that security seals often include a unique identifier, such as a bar code or unique identification number. Accordingly, the unique identifier allows the owner of the item to determine whether the primary seal has been severed and then replaced with a secondary seal which is similar in appearance to the primary seal. As can be appreciated, security seals are commonly used to secure the back door of a truck, this type of security seal being commonly referred to as a truck seal in the art.

Although well known and widely used in commerce, cable ties and fixed-loop ties of the type described above suffer from a notable drawback. Specifically, it has been found that ties of the type described above are susceptible to tampering. In fact, it has been found that, on occasion, unscrupulous consumers have been able to tamper with the locking tang in the head of the tie so as to disengage the locking tang from the strap, thereby enabling the consumer to back the strap out from the head and open the closed loop formed by the tie. As can be appreciated, when such a tie is used in a security application, such as to secure the lid of a pharmaceutical tote box in a closed position during shipping, the ability of an unscrupulous consumer to tamper with the tie can result in theft, which is highly undesirable.

SUMMARY OF THE INVENTION

It is an object of the present invention to provide a new and improved tie.

It is another object of the present invention to provide a tie of the type comprising a locking head and an attached strap, wherein the tie can be formed into a closed loop by inserting the strap into the locking head.

It is yet another object of the present invention to provide a tie of the type described above wherein the locking head includes a pawl which, with the strap inserted into the locking head, engages the strap to secure the tie in its closed loop configuration.

It is still another object of the present invention to provide a tie as described above which is constructed to prevent tampering of the pawl when the tie is formed in its closed loop configuration.

It is another object of the present invention to provide a tie as described above which can be constructed from a single molded piece.

It is yet another object of the present invention to provide a tie as described above which is inexpensive to manufacture and easy to use.

Accordingly, in one embodiment of the present invention, there is provided a tie comprising a head shaped to include an elongated strap accepting channel therethrough, the strap accepting channel having a longitudinal axis, a strap entry end and a strap exit end, and a strap having a first end and a second end, the first end being formed onto said head, said strap being sized and shaped to be inserted into the strap accepting channel so said tie forms a closed loop, said strap being adapted to be engaged by said head when said tie is formed into a closed loop, said strap being sized and shaped to substantially enclose the strap entry end and the strap exit end of the strap accepting channel when said tie is formed into a closed loop.

In another embodiment of the present invention, there is provided a tie comprising a head shaped to include an elongated strap accepting channel therethrough, the strap accepting channel having a longitudinal axis, a strap entry end, a first strap exit end and a second strap exit end, and a strap having a first end and a second end, the first end being formed onto said head, said strap being sized and shaped to be inserted into the strap accepting channel so said tie forms a closed loop, said strap being adapted to be engaged by said head when said tie is formed into a closed loop, said strap being sized and shaped to substantially enclosed the strap entry end, the first strap exit end and the second strap exit end when said tie is formed into a closed loop.

In another embodiment of the present invention, there is provided a tie comprising a head shaped to include an elongated interior channel therethrough, the interior channel having a longitudinal axis, a strap entry end and a strap exit end, said head comprising a locking tang which is disposed to project into the elongated interior channel, the locking tang extending approximately in parallel with the longitudinal axis of the strap accepting channel, and a strap having a first end and a second end, the first end being formed onto said head, said strap being sized and shaped to be inserted into the elongated interior channel so said tie forms a closed loop, said strap being adapted to be engaged by said head when said tie is formed into a closed loop, said strap being sized and shaped to substantially enclosed the strap entry end and the strap exit end of the interior channel when said tie is formed into a closed loop.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the present invention and, together with the description, serve to explain the principles of the invention. In the drawings, wherein like reference numerals represent like parts.

DETAILED DESCRIPTION OF A PREFERRED EMBODIMENT

Figure 1:
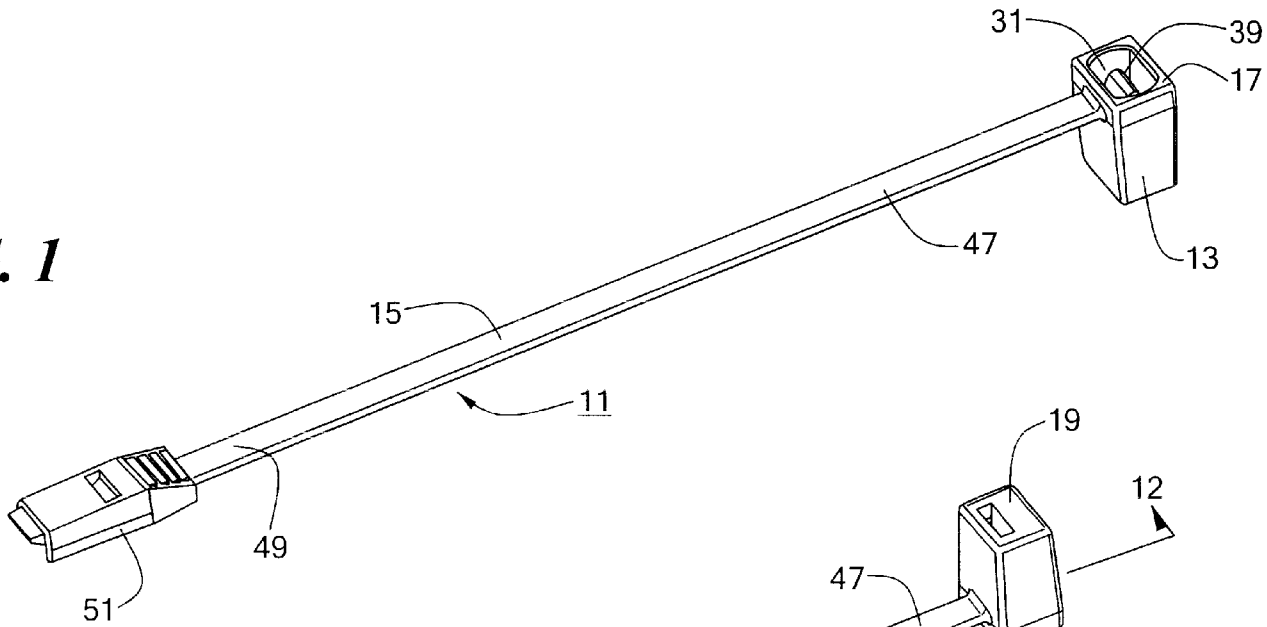
FIG. 1 is a bottom perspective view of a first embodiment of a tie constructed according to the teachings of the present invention.
Figure 2:
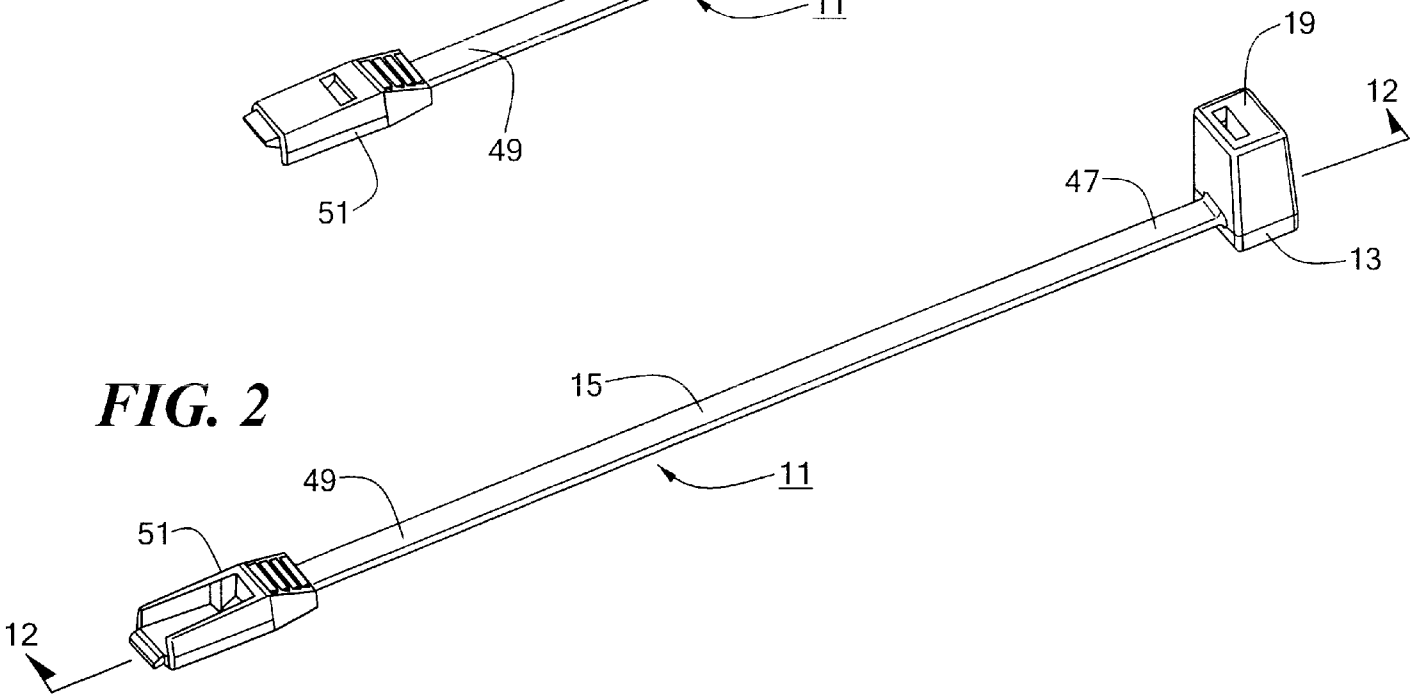
FIG. 2 is a top perspective view of the tie shown in FIG. 1.
Figure 3:
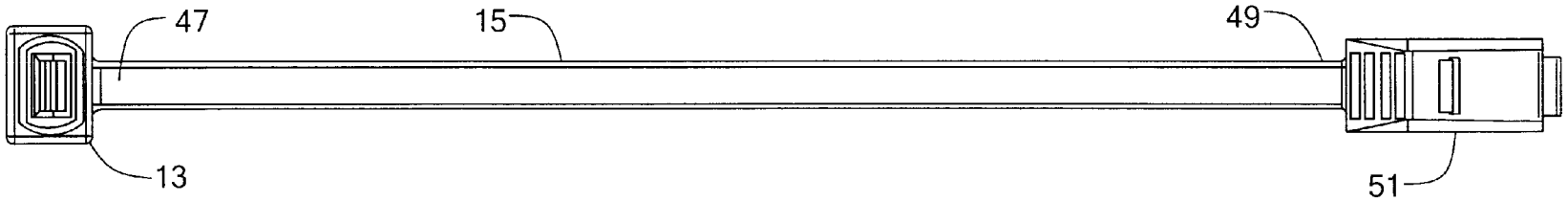
FIG. 3 is a bottom plan view of the tie shown in FIG. 1.
Figure 4:
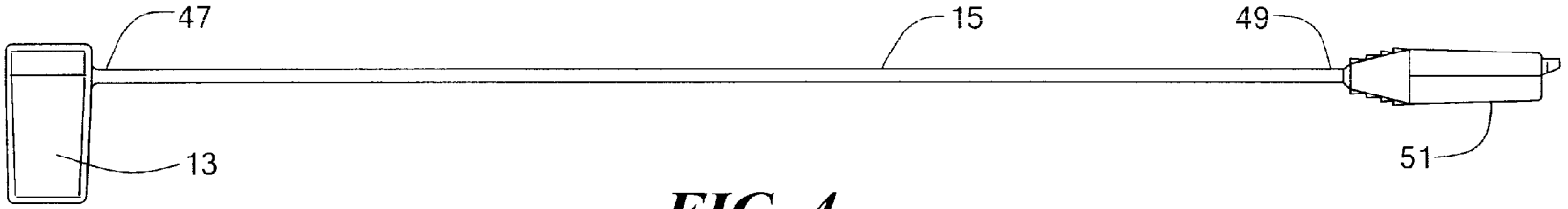
FIG. 4 is a side plan view of the tie shown in FIG. 1.
Figure 5:
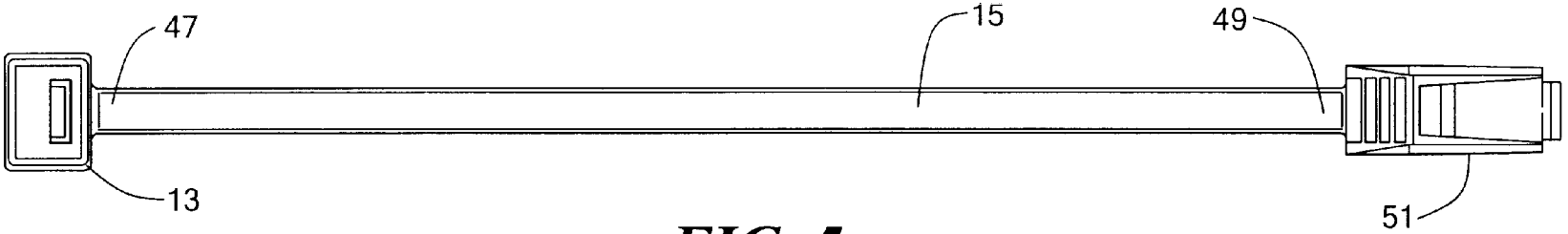
FIG. 5 is a top plan view of the tie shown in FIG. 1.

Referring now to FIGS. 1–5, there is provided a first embodiment of a tie constructed according to the teachings of the present invention, the tie being identified generally as reference numeral 11. As will be described further in detail below, the particular construction of tie 11 renders it unsusceptible to tampering when formed into a closed loop, which is highly desirable.

It should be noted that tie 11 can be used in any application in which necessitates a tie that can be formed into a fixed-sized closed loop. As an example, tie 11 can be used in high strength applications to secure the cover of pharmaceutical tote box or food supply container in its closed position during shipping and/or storage. As another example, tie 11 can be used in high strength applications to secure the door of a truck or storage room in its closed position. As another example, tie 11 can be used to securely fasten a ski tag onto an article of clothing, such as a ski jacket. As another example, tie 11 can be used to couple together two or more articles of commerce, such as shoes.

Tie 11 comprises a head 13 and an attached strap 15. Preferably, tie 11 is formed as a single piece using conventional molding techniques.

Figure 6:
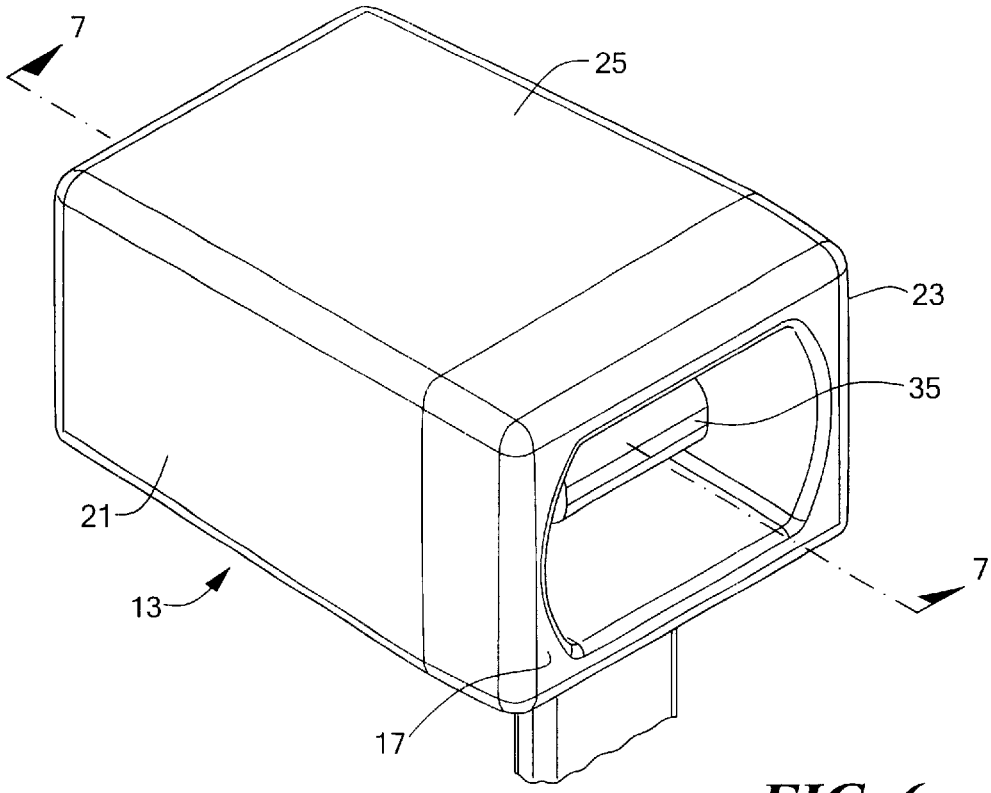
FIG. 6. is an enlarged, fragmentary, perspective view of the head of the tie shown in FIG. 1.
Figure 7:
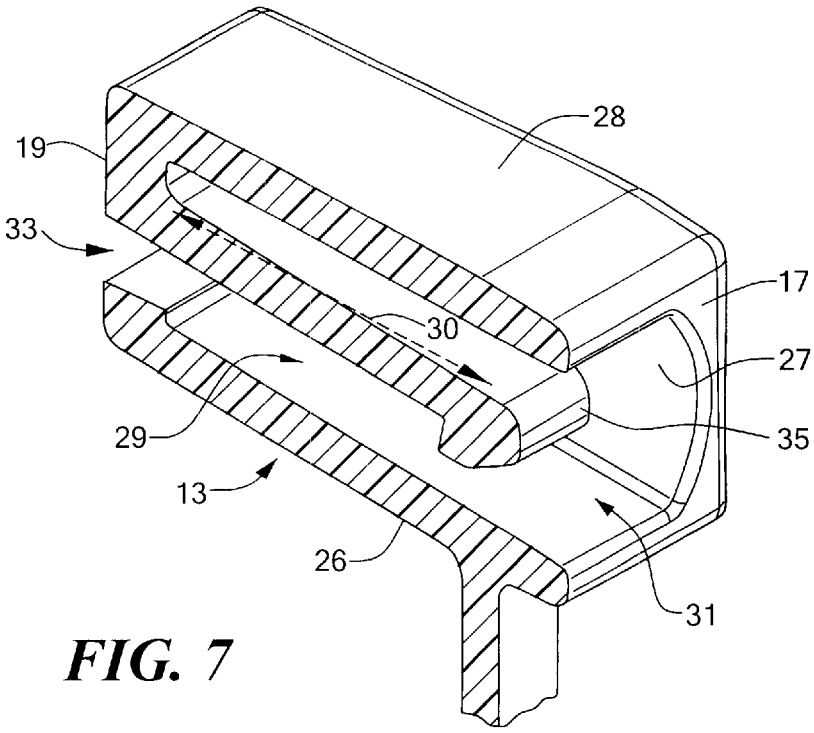
FIG. 7 is an enlarged, fragmentary, perspective, section view of the head of the tie shown in FIG. 6, taken along lines 7—7.
Figure 8:
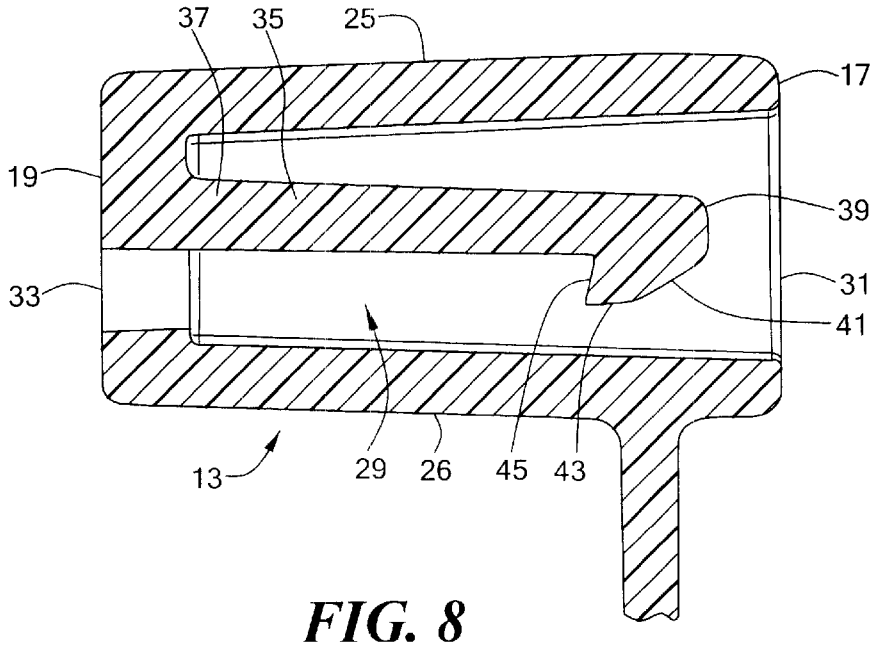
FIG. 8 is an enlarged, fragmentary, plan, section view of the head of the tie shown in FIG. 6, taken along lines 7—7.

Referring now to FIGS. 6–8, head 13 is generally rectangular in shape and comprises a bottom wall 17, a top wall 19, a first sidewall 21, a second sidewall 23, an outer end wall 25 and an inner end wall 26. Bottom wall 17, top wall 19, first sidewall 21, second sidewall 23, outer end wall 25 and inner end wall 26 together define an inner surface 27 for head 13, an outer surface 28 for head 13 and an elongated, interior, strap accepting channel 29.

Strap accepting channel 29 extends longitudinally through head 13 from bottom wall 17 to top wall 19. Strap accepting channel 29 includes a longitudinal axis 30, a strap entry end 31 formed in bottom wall 17 and a strap exit end 33 formed in top wall 19. It should be noted that strap exit end 33 is considerably small in size, thereby rendering tie 11 less susceptible to pawl tampering, which is highly desirable.

Head 13 also comprises a locking tang 35 which is integrally formed onto inner surface 27 of top wall 19. Locking tang 35 projects into interior channel 29 approximately parallel with longitudinal axis 30, outer end wall 25 and inner end wall 26. Preferably, locking tang 35 is of the deflectable type which is capable of articulation. However, it is to be understood that locking tang 35 could alternatively be of the stationary type which is incapable of articulation without departing from the spirit of the present invention.

Locking tang 35 is in the form of an elongated arm which includes a first end 37 and a second end 39. First end 37 of locking tang 35 is integrally formed onto inner surface 27 of top wall 19. Second end 39 of locking tang 35 is in the form of an enlarged head which includes a beveled surface 41, a flat abutment surface 43 and an engagement shelf 45, engagement shelf 45 being directed towards inner end wall 26. As will be described further in detail below, second end 39 of locking tang 35 is sized and shaped to engage strap 15 so as to secure tie 11 in a looped configuration.

As shown in FIGS. 1–5, strap 15 is an elongated flexible member which is generally uniform and rectangular in lateral cross-section. However, it is to be understood that strap 15 could be constructed in alternative sizes and shapes without departing from the spirit of the present invention.

Strap 15 comprises a first end 47 and a second end 49. First end 47 is integrally formed on head 13 so as to render tie 11 a unitary device.

Figure 9:
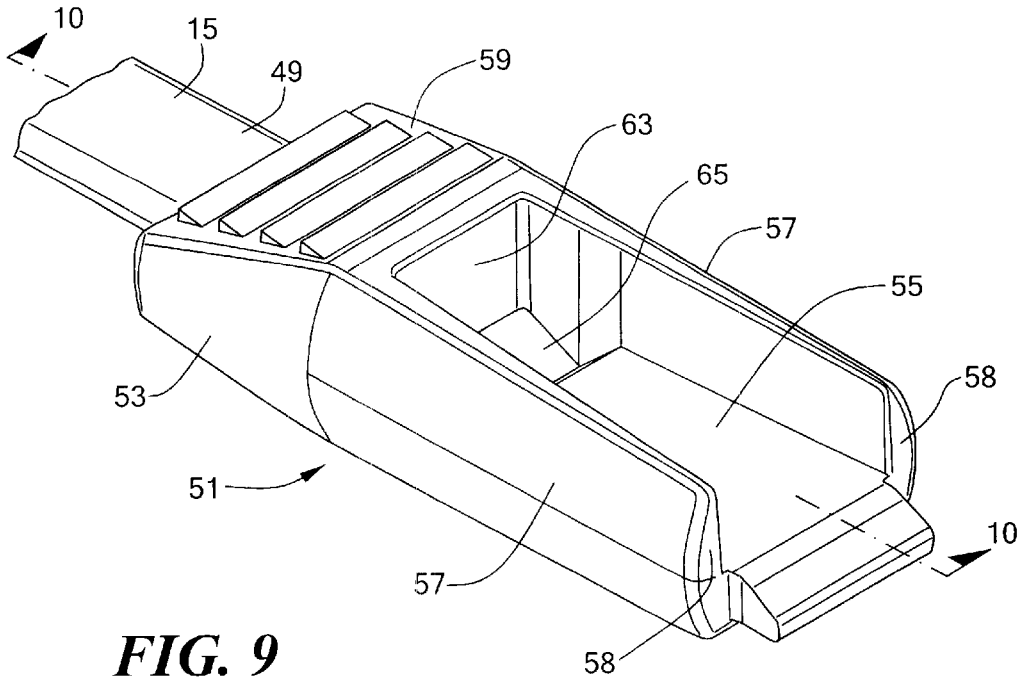
FIG. 9 is an enlarged, fragmentary, perspective view of the anti-tampering device of the tie shown in FIG. 1.
Figure 10:
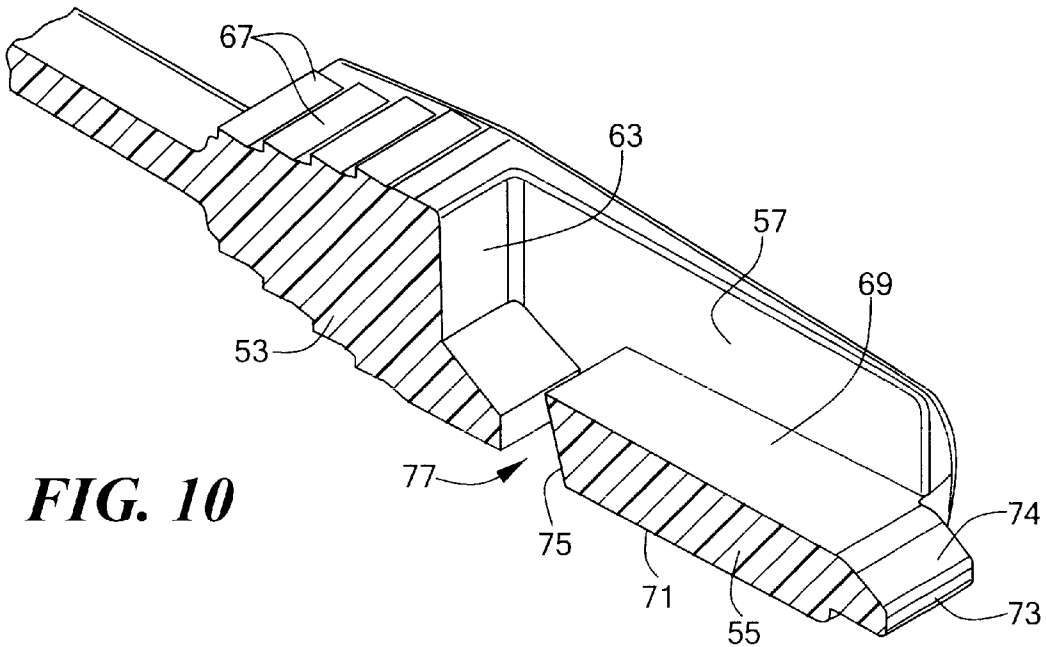
FIG. 10 is an enlarged, fragmentary, perspective, section view of the anti-tampering device of the tie shown in FIG. 9, taken along lines 10—10.
Figure 11:
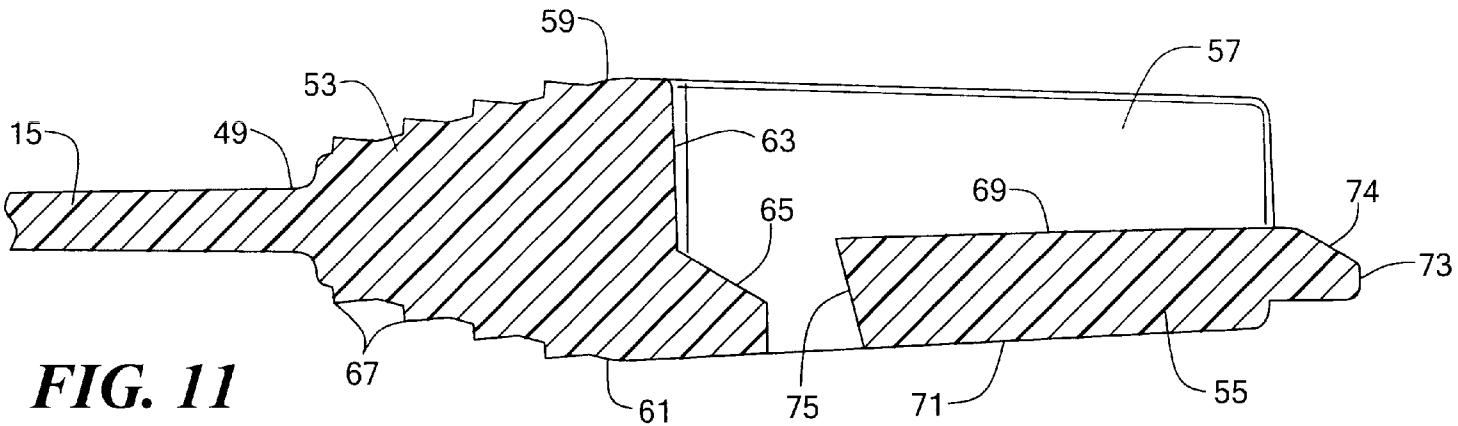
FIG. 11 is an enlarged, fragmentary, plan, section view of the head of the tie shown in FIG. 9, taken along lines 10—10.
Figure 12A:
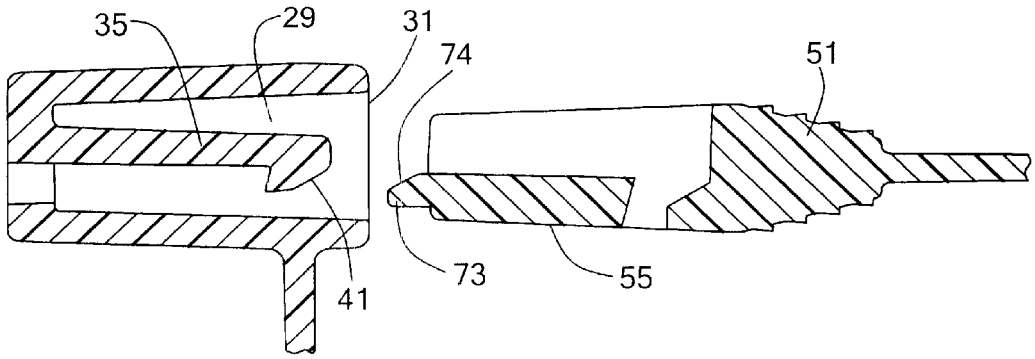
FIGS. 12(*a*)–(*f*) represent a series of fragmentary, section views of the tie shown in FIG. 2, taken along lines 12—12, as the anti-tampering device is inserted into the head.
Figure 12B:
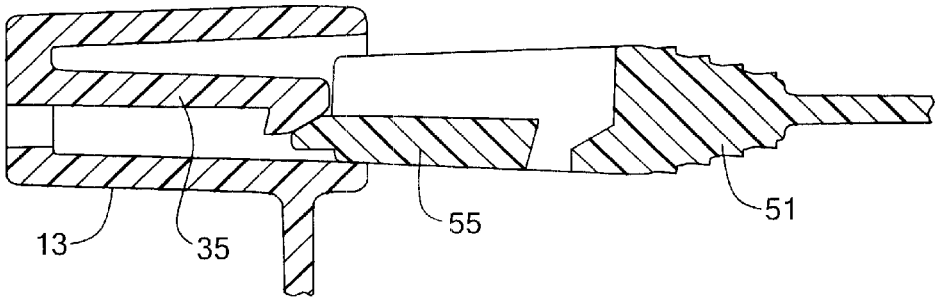
Figure 12C:
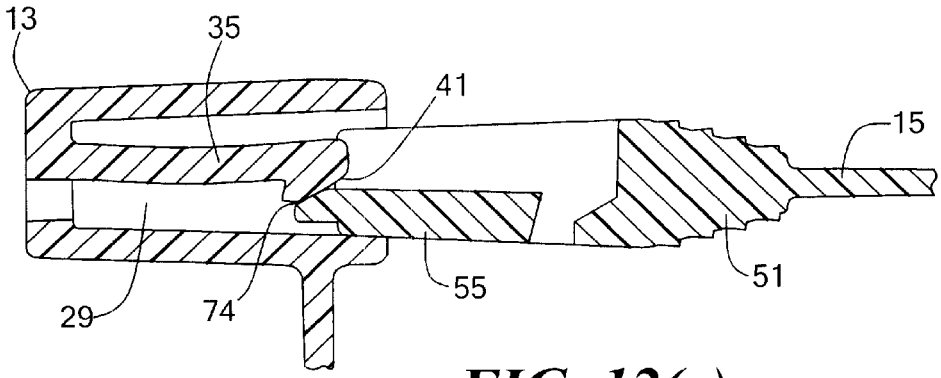
Figure 12D:
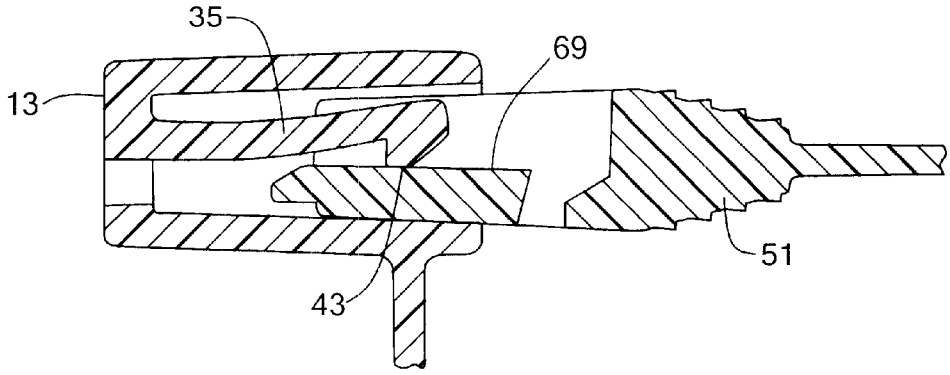
Figure 12E:
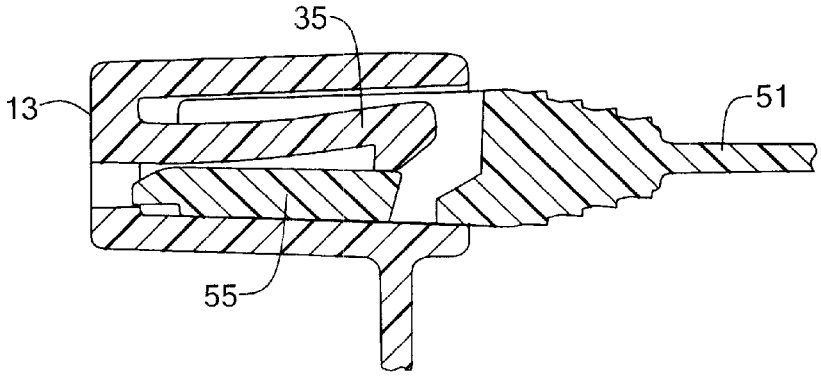
Figure 12F:
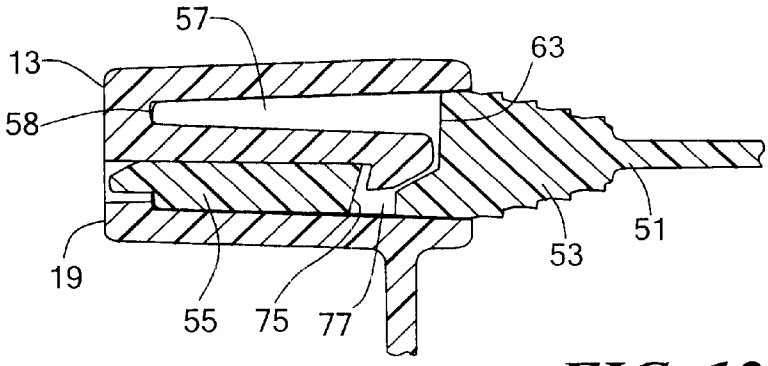

Referring now to FIGS. 9–11, strap 15 also comprises an anti-tampering device 51 which is integrally formed onto second end 49 of strap 15. As will be described further in detail below, anti-tampering device 51 can be inserted into head 13 so as to form tie 11 into a closed loop. Accordingly, it should be noted that anti-tampering device 51 serves a plurality of functions. Specifically, anti-tampering device 51 is adapted to be engaged by locking tang 35 when tie 11 is formed into a closed loop, thereby preventing strap 15 from being backed out of head 13. In addition, anti-tampering device 51 is sized and shaped to substantially enclose entry end 31 and exit end 33 of strap accepting channel 29 when tie 11 is formed into a closed loop, thereby rendering locking tang 35 of tie 11 unsusceptible to tampering. Furthermore, anti-tampering device 51 serves as a mechanism for limiting the minimum size of the closed loop which can be formed by tie 11.

Anti-tampering device 51 comprises a plug 53, a finger 55, and a pair of sidewalls 57 which are integrally formed onto plug 53 and finger 55 so as to render anti-tampering device 51 a unitary piece.

Plug 53 is an enlarged member which is integrally formed onto second end 49 of strap 15. Plug 53 comprises an angled top surface 59, an angled bottom surface 61, and an inner surface 63 which is shaped to include a beveled surface 65.

It should be noted that plug 53 is sized and shaped to substantially enclose entry end 31 of strap accepting channel 29 when tie 11 is formed into a closed loop, as will be described further below. As such, an unscrupulous person is incapable of tampering with locking tang 35 through entry end 31, which is highly desirable.

A plurality of finger gripping steps, or serrations, 67 are integrally formed onto top surface 59 and bottom surface 61. As can be appreciated, the generally trapezoidal shape of plug 53 in longitudinal cross-section as well as the inclusion of finger gripping steps 67 enables an operator to easily grasp anti-tampering device 51 and insert anti-tampering device 51 into head 13, which is highly desirable.

It should be noted that plug 53 is not limited to having an enlarged, generally trapezoidal shape. Rather, it is to be understood that plug 53 could be formed into any shape which substantially encloses entry end 31 of strap accepting channel 29 when tie 11 is formed into its looped configuration without departing from the spirit of the present invention. For example, plug 53 may have a rectangular shape in longitudinal cross-section without departing from the spirit of the present invention.

Finger 55 is in the form of an elongated, thin member which is generally rectangular in lateral cross-section. Finger 55 includes a flat top surface 69, a flat bottom surface 71, a first end 73 which is in the form of a projection having a beveled surface 74 and a second end 75 which is in the form of an angled, or beveled, edge.

It should be noted that first end 73 is in the form of a projection which is sized and shaped to substantially enclose exit end 33 of strap accepting channel 29 when tie 11 is formed into a closed loop, as will be described further below. As such, an unscrupulous person is incapable of tampering with locking tang 35 through exit end 33, which is highly desirable.

Sidewalls 57 are disposed in a spaced apart, parallel relationship and are integrally formed onto plug 53 and finger 55. It should be noted that plug 53 and finger 55 are spaced slightly apart so as to define an opening 77 therebetween.

In use, tie 11 can be formed into a closed loop in the following manner. Specifically, grasping top surface 59 and bottom surface 61 of plug 53, the user bends tie 11 in such a manner that anti-tampering device 51 is directed into strap entry end 31 of strap accepting channel 29.

Referring now to FIG. 12(*a*), anti-tampering device 51 is aligned for insertion into strap entry end 31 of strap accepting channel 29 with first end 73 of finger 55 directed into strap accepting channel 29. Referring now to FIG. 12(*b*), as anti-tampering device 51 is inserted into head 13, tie 11 forms a closed loop. In particular, as anti-tampering device 51 is inserted into head 13, beveled surface 74 of finger 55 contacts beveled surface 41 of locking tang 35.

Referring now to FIG. 12(*c*) the taper of beveled surface 74 and the taper of beveled surface 41 causes locking tang 35 to pivot upward and ride along finger 55 as strap 15 is advanced in the forward direction into interior channel 29. Continued advancement of anti-tampering device 51 in the forward direction into head 13 causes flat abutment surface 43 of locking tang 35 to contact and slide along flat top surface 69 of finger 55, as shown in FIGS. 12(*d*) and 12(*e*).

Referring now to FIG. 12(*f*), further advancement of anti-tampering device 51 eventually causes front surface 58 of sidewalls 57 to abut against inner surface 27 of top wall 19, thereby precluding further forward advancement of anti-tampering device 51. Simultaneously, as anti-tampering device 51 is advanced forward, locking tang 35 travels along the entire length of flat top surface 69 and eventually resiliently pivots back down into opening 77 between second end 75 of finger 55 and inner surface 63 of plug 53, thereby lockably securing anti-tampering device 51 within head 13. Accordingly, upon the application of a rearward withdrawal force on strap 15, the beveled edge of second end 75 would abut against engagement shelf 45 and actually pull locking tang 35 downward, thereby locking anti-tampering device 51 within strap accepting channel 29 so as to preclude removal of strap 15 from head 13, which is highly desirable.

Figure 13:
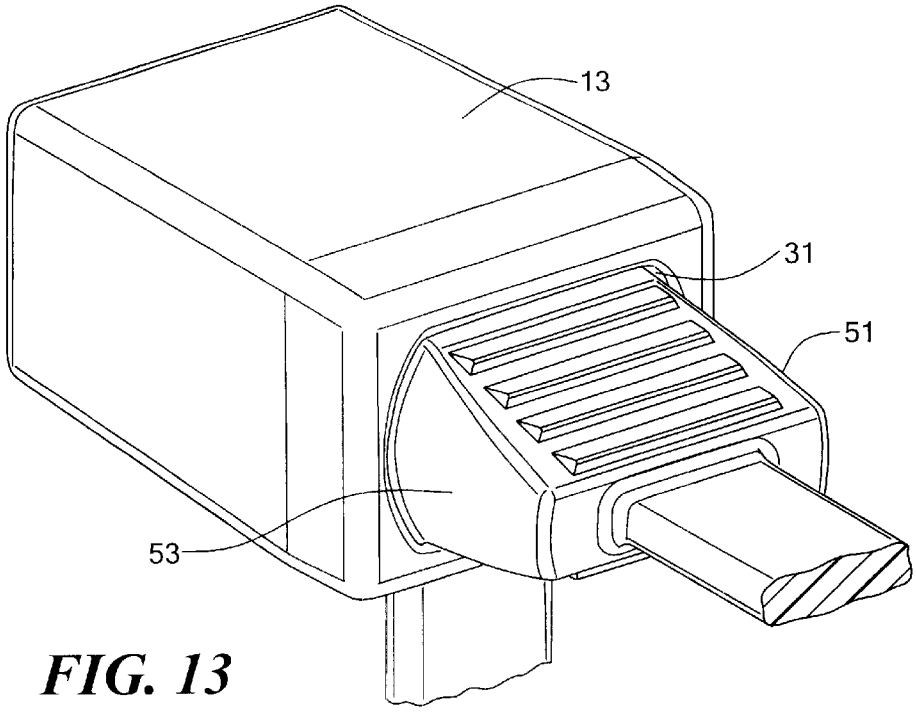
FIG. 13 is an enlarged, fragmentary, bottom perspective view of the tie shown in FIG. 1, the tie being shown with the anti-tampering device inserted into the head.

It should be noted that, with anti-tampering device 51 fully inserted into head 13, the particular size and shape of plug 53 serves to substantially enclose entry end 31 of strap accepting channel 29, as shown in FIG. 13. Accordingly, an unscrupulous person is precluded from tampering with locking tang 35 through entry end 31, which is highly desirable.

Figure 14:
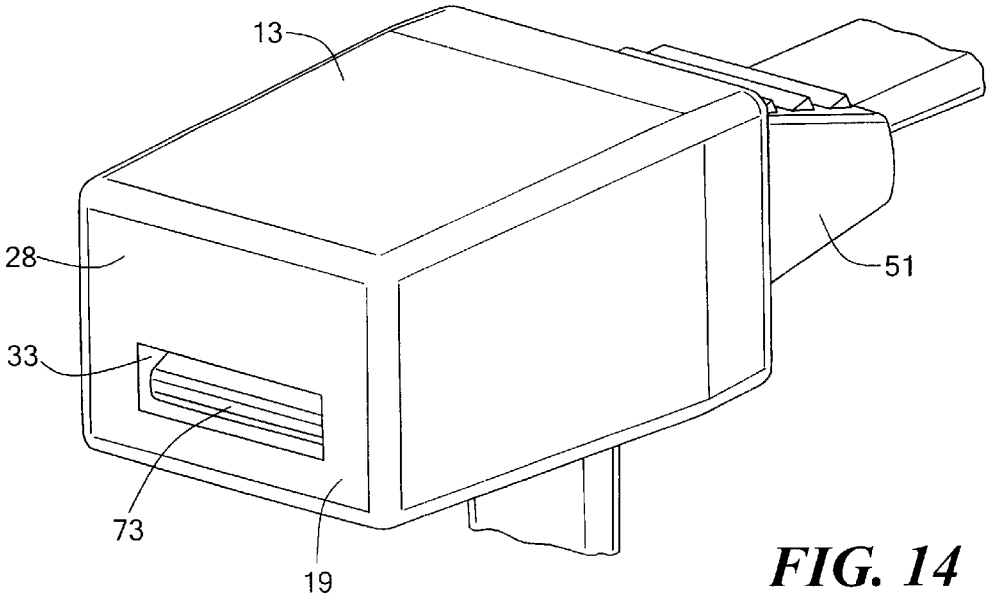
FIG. 14 is an enlarged, fragmentary, top perspective view of the tie shown in FIG. 1, the tie being shown with the anti-tampering device inserted into the head.
Figure 15:
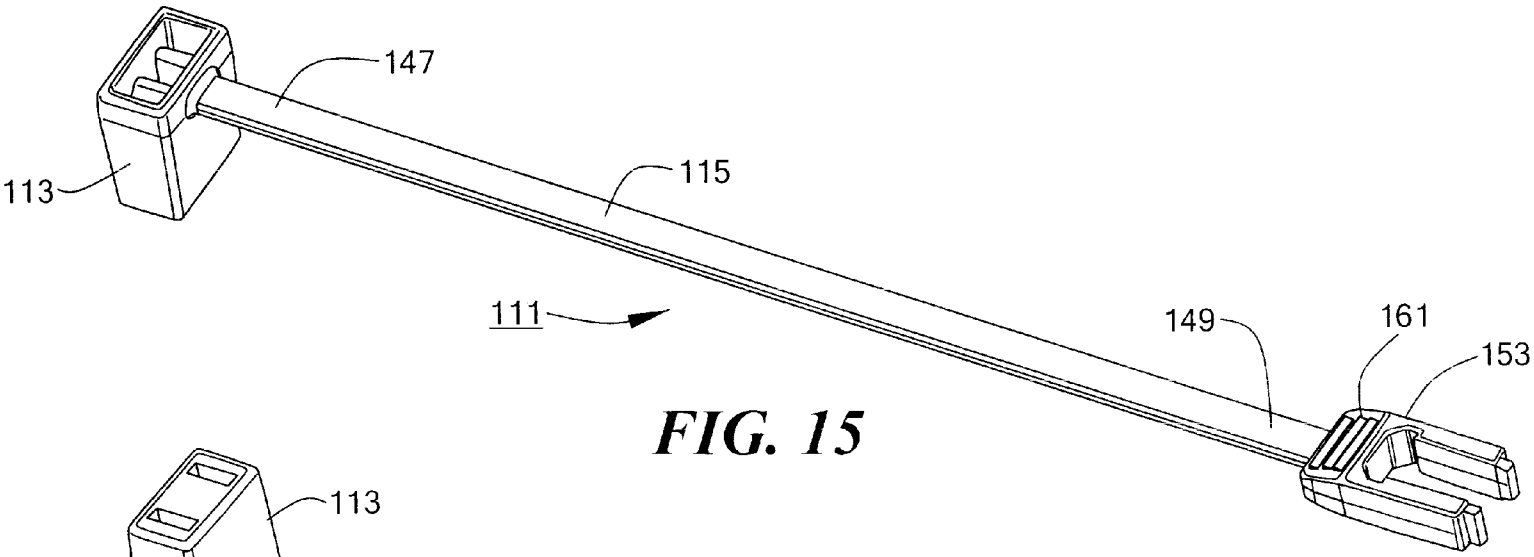
FIG. 15 is a bottom perspective view of a second embodiment of a tie constructed according to the teachings of the present invention.
Figure 16:
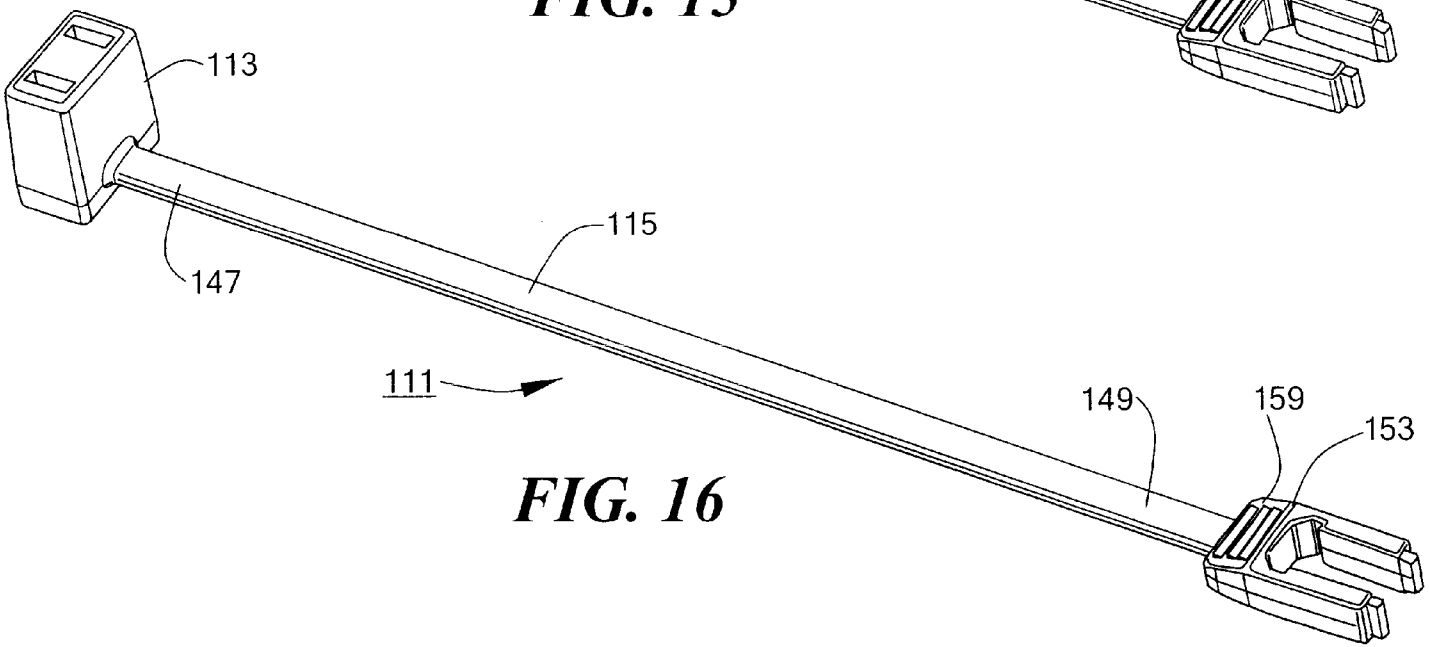
FIG. 16 is a top perspective view of the tie shown in FIG. 15.
Figure 17:
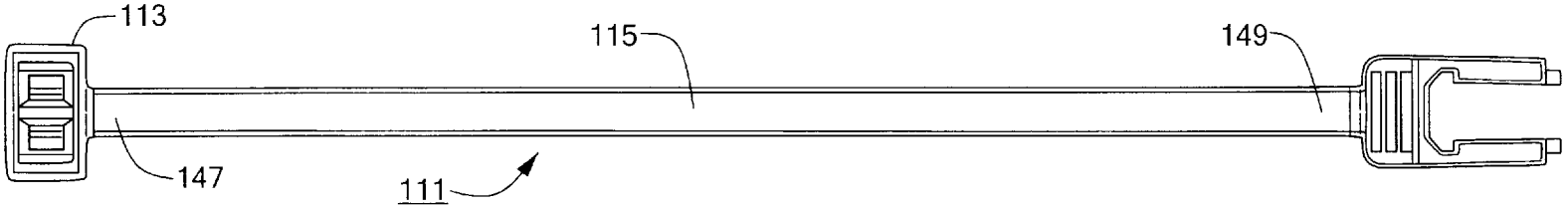
FIG. 17 is a bottom plan view of the tie shown in FIG. 15.
Figure 18:
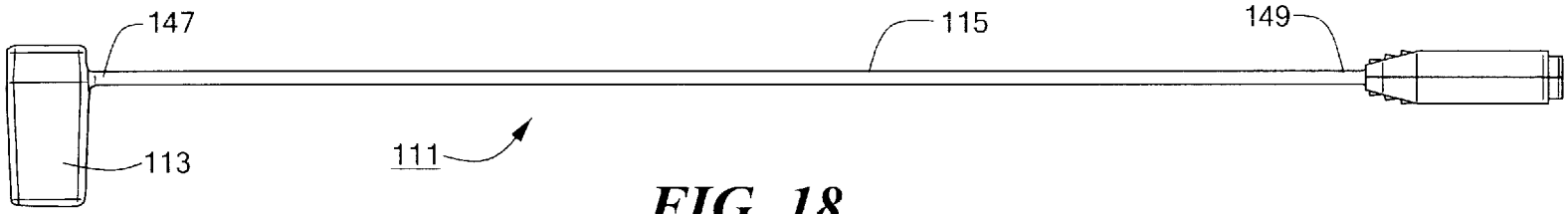
FIG. 18 is a side plan view of the tie shown in FIG. 15.
Figure 19:
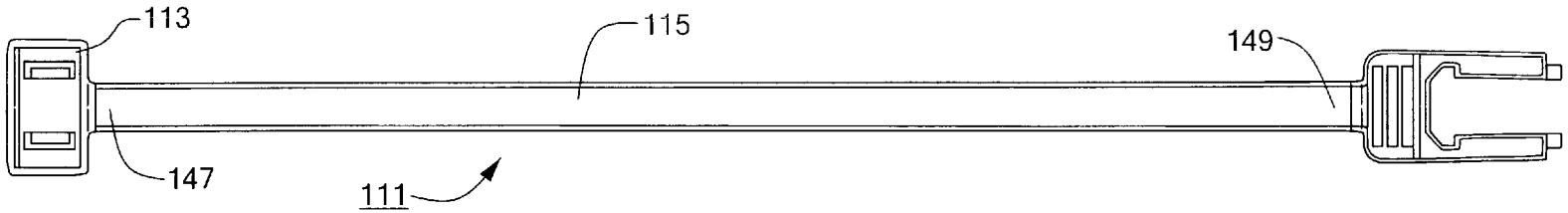
FIG. 19 is a top plan view of the tie shown in FIG. 15.

It should also be noted that, with anti-tampering device 51 fully inserted into head 13, the particular size and shape of first end 73 of finger 55 serves to substantially enclose exit end 33 of strap accepting channel 29, as shown in FIG. 14. Accordingly, an unscrupulous person is precluded from tampering with locking tang 35 through exit end 33, which is highly desirable.

It should be further noted that, with anti-tampering device 51 fully inserted into head 13, first end 73 of finger 55 is disposed flush against, or slightly in from, outer surface 28 of top wall 19, which is highly desirable. Specifically, it has been found to be desirable to retain first end 73 of finger 55 within head 13 to prevent the inadvertent catching or scraping of strap 15 against an item.

Referring now to FIGS. 15–19, there is provided another embodiment of a tie constructed according to the teachings of the present invention, the tie being identified generally by reference numeral 111. As will be described further in detail below, the particular construction of tie 111 renders it unsusceptible to tampering when formed into a closed loop, which is highly desirable.

It should be noted that tie 111 can be used in any application in which necessitates a tie that can be formed into a fixed-sized closed loop. As an example, tie 111 can be used in high strength applications to secure the cover of pharmaceutical tote box or food supply container in its closed position during shipping and/or storage. As another example, tie 111 can be used in high strength applications to secure the door of a truck or storage room in its closed position. As another example, tie 111 can be used to securely fasten a ski tag onto an article of clothing, such as a ski jacket. As another example, tie 111 can be used to couple together two or more articles of commerce, such as shoes.

Tie 111 comprises a head 113 and an attached strap 115. Preferably, tie 111 is formed as a single piece using conventional molding techniques.

Figure 20:
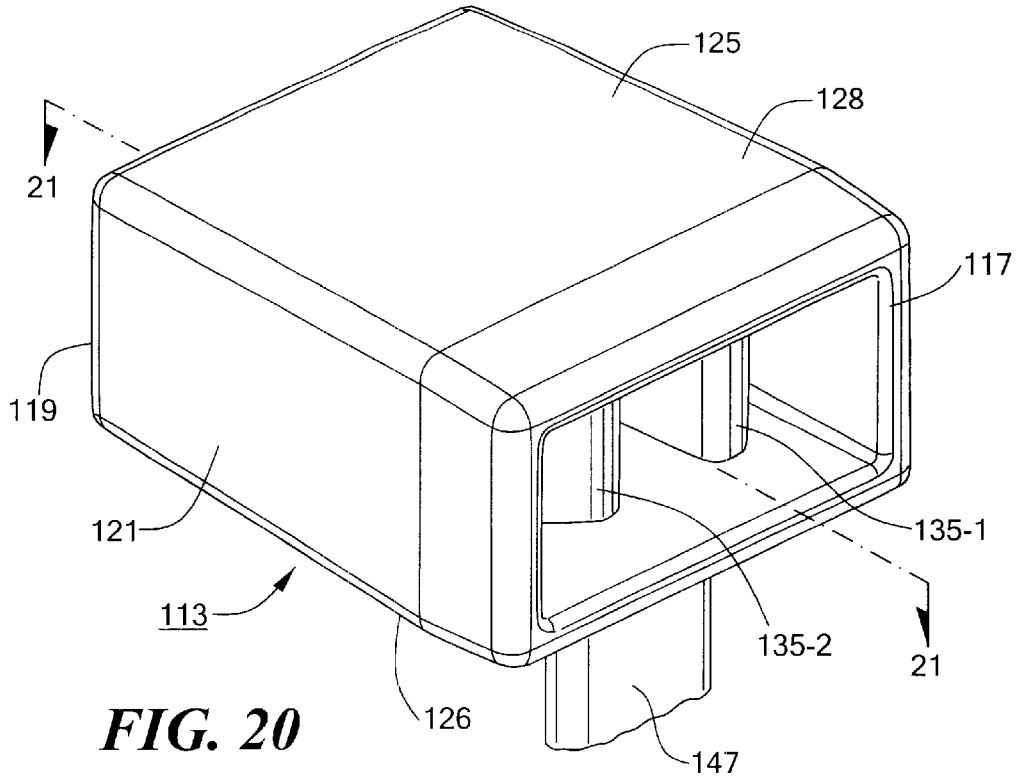
FIG. 20 is an enlarged, fragmentary, perspective view of the head of the tie shown in FIG. 15.
Figure 21:
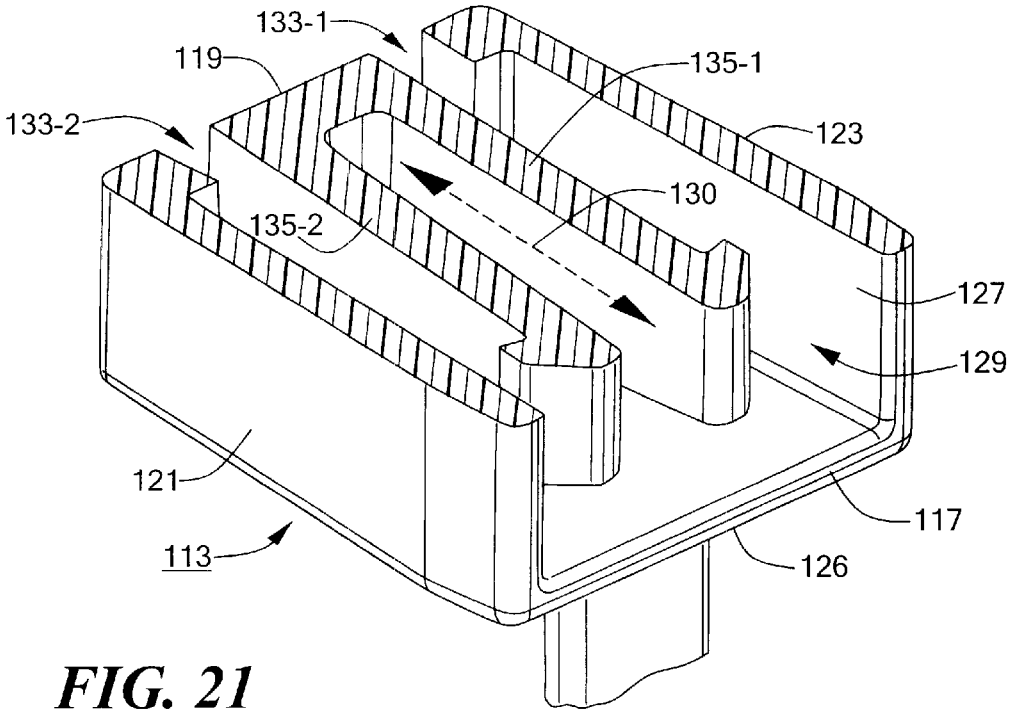
FIG. 21 is an enlarged, fragmentary, perspective, section view of the head of the tie shown in FIG. 20, taken along lines 21—21.
Figure 22:
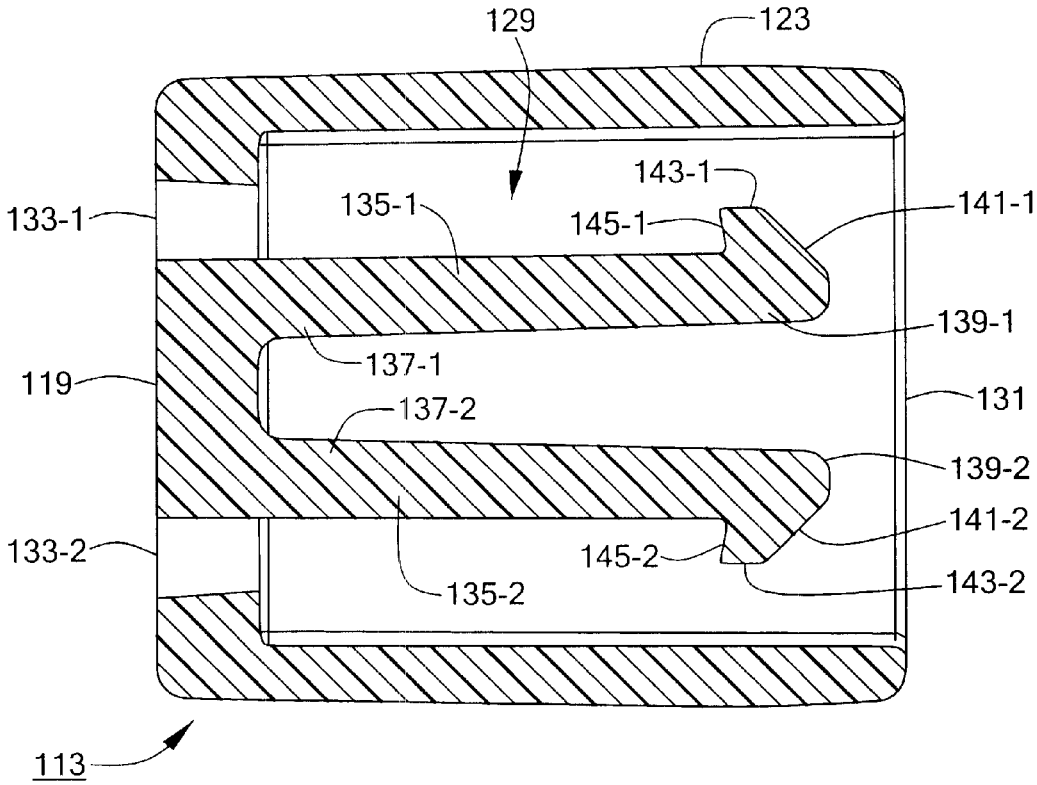
FIG. 22 is an enlarged, fragmentary, plan, section view of the head of the tie shown in FIG. 20, taken along lines 21—21.

Referring now to FIGS. 20–22, head 113 is generally rectangular in shape and comprises a bottom wall 117, a top wall 119, a first sidewall 121, a second sidewall 123, an outer end wall 125 and an inner end wall 126. Bottom wall 117, top wall 119, first sidewall 121, second sidewall 123, outer end wall 125 and inner end wall 126 together define an inner surface 127 for head 113, an outer surface 128 for head 113 and an elongated, interior, strap accepting channel 129.

Strap accepting channel 129 extends longitudinally through head 113 from bottom wall 117 to top wall 119. Strap accepting channel 129 includes a longitudinal axis 130, a strap entry end 131 formed in bottom wall 117 and a pair of spaced apart, rectangular, strap exit ends 133-1 and 133-2 formed in top wall 119. It should be noted that each strap exit end 133 is considerably small in size, thereby rendering tie 111 less susceptible to pawl tampering, which is highly desirable.

Head 113 also comprises a pair of locking tangs 135-1 and 135-1 which are integrally formed onto inner surface 127 of top wall 119. Locking tangs 135 project into interior channel 129 approximately parallel with longitudinal axis 130, first sidewall 121 and second sidewall 123.

Preferably, locking tangs 135 are of the deflectable type which are capable of articulation. Specifically, locking tangs 135 are preferably capable of inward flexion towards one another upon the application of a compressive force. Upon the removal of the compressive force, locking tangs 135 are constructed to resiliently pivot back outward to their original orientation. Although locking tangs 135 are preferably of the deflectable type, it is to be understood that locking tangs 135 could alternatively be of the stationary type which are incapable of articulation without departing from the spirit of the present invention.

Each locking tang 135 is in the form of an elongated arm which includes a first end 137 and a second end 139. First end 137 of each locking tang 135 is integrally formed onto inner surface 127 of top wall 119. Second end 139 of each locking tang 135 is in the form of an enlarged head which includes a beveled surface 141, a flat abutment surface 143 and an engagement shelf 145, engagement shelf 145-1 of locking tang 135-1 extending towards second sidewall 123 and engagement shelf 145-2 of locking tang 135-2 extending towards first sidewall 121. As will be described further in detail below, second end 139 of locking tangs 135 are sized and shaped to engage strap 115 so as to secure tie 111 in a closed loop configuration.

As shown in FIGS. 15–19, strap 115 is an elongated flexible member which is generally uniform and rectangular in lateral cross-section. However, it is to be understood that strap 115 could be constructed in alternative sizes and shapes without departing from the spirit of the present invention.

Strap 115 comprises a first end 147 and a second end 149. First end 147 is integrally formed onto head 113 so as to render tie 111 a unitary device.

Figure 23:
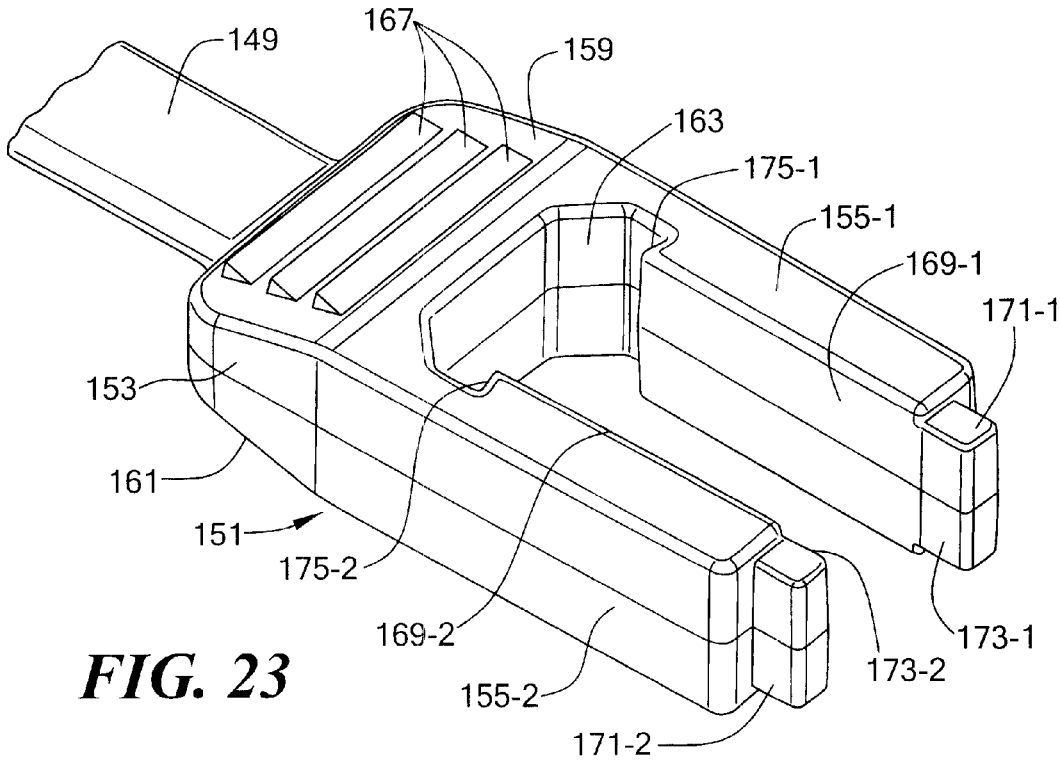
FIG. 23 is an enlarged, fragmentary, perspective view of the anti-tampering device of the tie shown in FIG. 15.
Figure 24A:
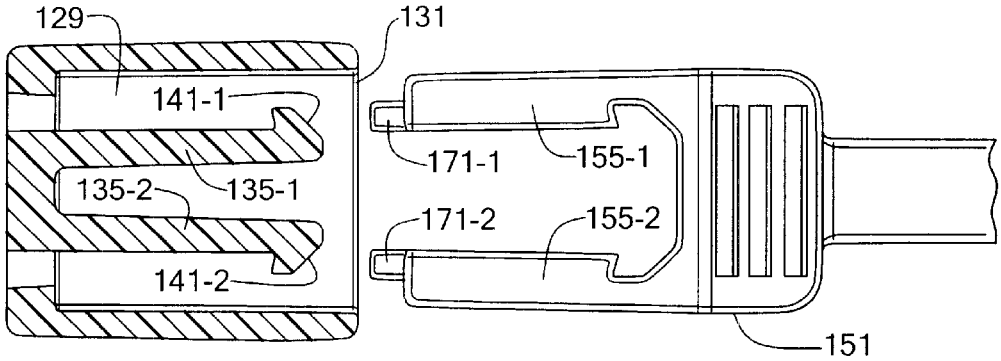
FIGS. 24(*a*)–(*e*) represent a series of fragmentary views of the tie shown in FIG. 15 as the anti-tampering device is inserted into the head, the head of the tie being shown in section taken along lines 21—21.
Figure 24B:
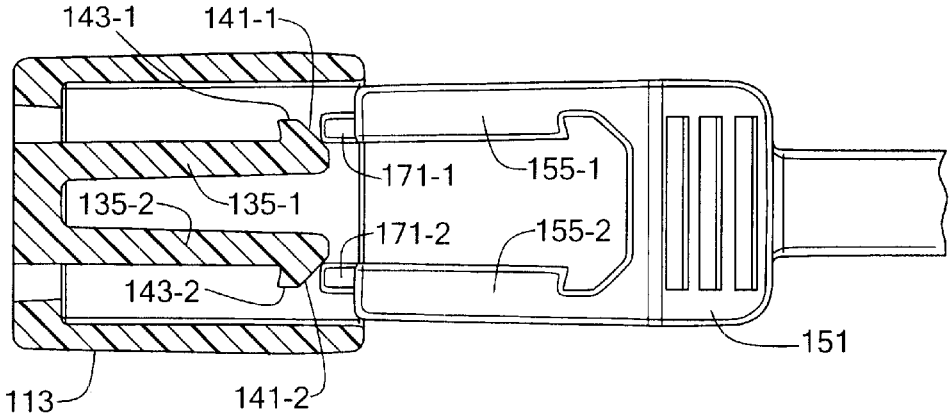
Figure 24C:
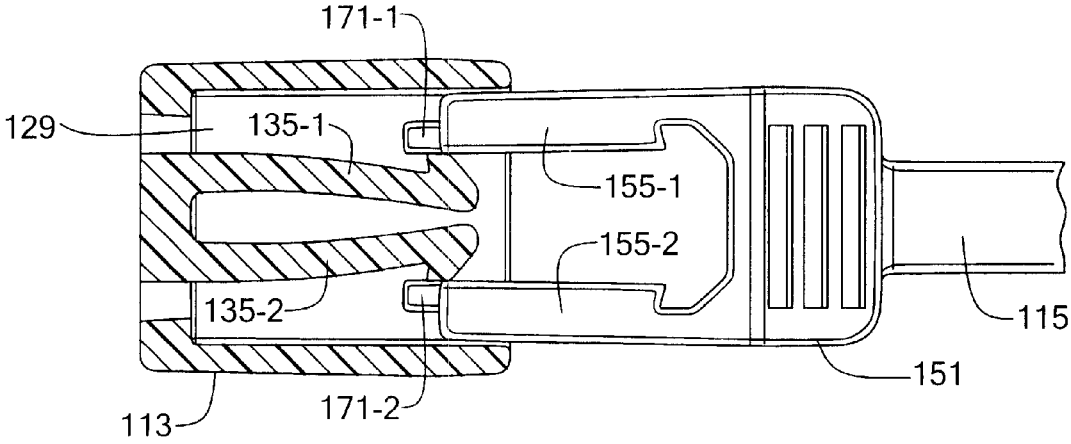
Figure 24D:
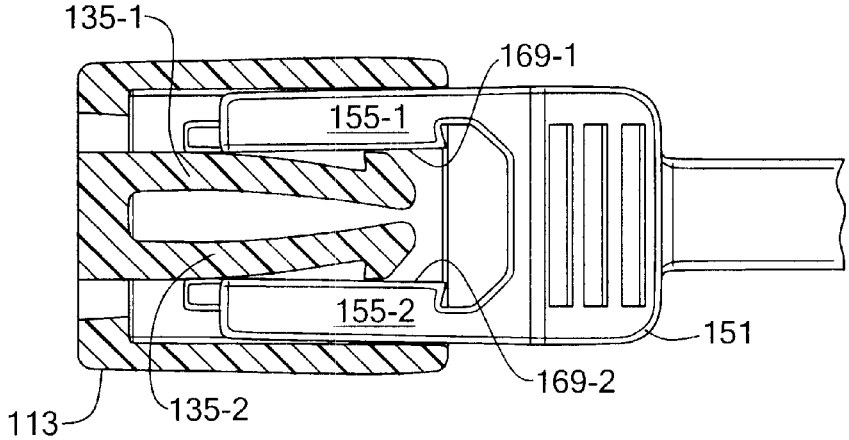
Figure 24E:
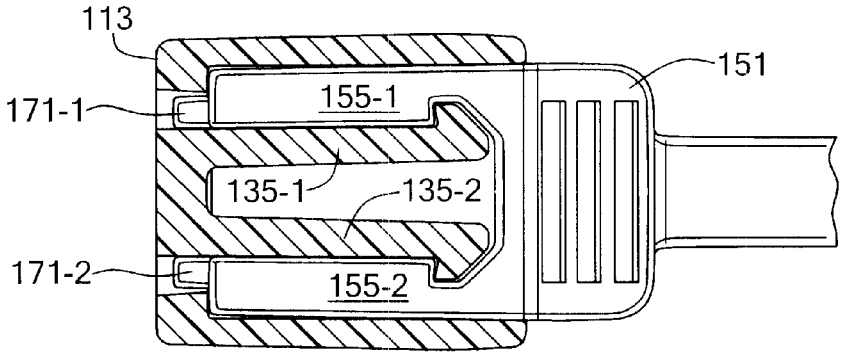

Referring now to FIG. 23, strap 115 also comprises an anti-tampering device 151 which is integrally formed onto second end 149 of strap 115. As will be described further in detail below, anti-tampering device 151 can be inserted into head 113 so as to form tie 111 into a closed loop. Accordingly, it should be noted that anti-tampering device 151 serves a plurality of functions. Specifically, anti-tampering device 151 is adapted to be engaged by locking tangs 135 when tie 111 is formed into a closed loop, thereby preventing strap 115 from being backed out of head 113. In addition, anti-tampering device 151 is sized and shaped to substantially enclose entry end 131 and exit ends 133 of strap accepting channel 129 when tie 111 is formed into a closed loop, thereby rendering locking tangs 135 of tie 111 unsusceptible to tampering. Furthermore, anti-tampering device 151 serves as a mechanism for limiting the minimum size of the closed loop which can be formed by tie 111.

Anti-tampering device 151 comprises a plug 153 and a pair of fingers 155-1 and 155-2 which are integrally formed onto plug 153 so as to render anti-tampering device 151 a unitary piece.

Plug 153 is an enlarged member which is integrally formed onto second end 149 of strap 115. Plug 153 comprises an angled top surface 159, an angled bottom surface 161, and a multi-sided inner surface 163.

It should be noted that plug 153 is sized and shaped to substantially enclose entry end 131 of strap accepting channel 129 when tie 111 is formed into a closed loop, as will be described further below. As such, an unscrupulous person is incapable of tampering with locking tangs 135 through entry end 131, which is highly desirable.

A plurality of finger gripping steps, or serrations, 167 are integrally formed onto top surface 159 and bottom surface 161. As can be appreciated, the generally trapezoidal shape of plug 153 in longitudinal cross-section as well as the inclusion of finger gripping steps 167 enables an operator to easily grasp plug 153 and insert anti-tampering device 151 into head 113, which is highly desirable.

It should be noted that plug 153 is not limited to having an enlarged, generally trapezoidal shape. Rather, it is to be understood that plug 153 could be formed into any shape which substantially encloses entry end 131 of strap accepting channel 129 when tie 111 is formed into its looped configuration without departing from the spirit of the present invention. For example, plug 153 may have a rectangular shape in longitudinal cross-section without departing from the spirit of the present invention.

Fingers 155-1 and 155-2 extend from plug 153 in a spaced apart, parallel configuration and are preferably constructed to be rigid and incapable of flexion. Each finger 155 is the form of an elongated, thin member which is generally rectangular in lateral cross-section. Each finger 155 includes a flat contact surface 169, a first end 171 which is in the form of a projection having a flat abutment surface 173 and a second end 175 which is in the form of an undercut.

It should be noted that first end 171-1 of finger 155-1 is in the form of a generally rectangular projection which is sized and shaped to substantially enclose exit end 133-1 of strap accepting channel 129 when tie 111 is formed into a closed loop. Similarly, it should be noted that first end 171-2 of finger 155-2 is in the form of a generally rectangular projection which is sized and shaped to substantially enclose exit end 133-2 of strap accepting channel 129 when tie 111 is formed into a closed loop, as will be described further below. As such, an unscrupulous person is incapable of tampering with locking tangs 135 through exit ends 133, which is highly desirable.

In use, tie 111 can be formed into a closed loop in the following manner. Specifically, grasping top surface 159 and bottom surface 161 of plug 153, the user bends tie 111 in such a manner that anti-tampering device 151 is directed into strap entry end 131 of strap accepting channel 129.

Referring now to FIG. 24(*a*), anti-tampering device 151 is aligned for insertion into strap entry end 131 of strap accepting channel 129 with first end 171-1 of finger 155-1 in alignment with beveled surface 141-1 of locking tang 135-1 and with first end 171-2 of finger 155-2 in alignment with beveled surface 141-2 of locking tang 135-2. Referring now to FIG. 24(*b*), as anti-tampering device 151 is inserted into head 113, tie 111 forms a closed loop. In particular, as anti-tampering device 151 is inserted into head 113, first end 171-1 of finger 155-1 contacts beveled surface 141-1 of locking tang 135-1 and first end 171-2 of finger 155-2 contacts beveled surface 141-2 of locking tang 135-1.

Referring now to FIG. 24(*c*), as strap 115 is advanced in the forward direction into interior channel 129, first end 171-1 of finger 155-1 slides along locking tang 135-1 and contacts flat abutment surface 143-1. Simultaneously, first end 171-2 of finger 155-2 slides along locking tang 135-2 and contacts flat abutment surface 143-2. In this manner, fixed fingers 155-1 and 155-2 act to inwardly compress locking tangs 135-1 and 135-2, respectively.

Referring now to FIG. 24(*d*), continued advancement of anti-tampering device 151 in the forward direction into head 113 causes flat contact surface 169-1 of finger 155-1 to slide against flat abutment surface 143-1 of locking tang 135-1. Simultaneously, flat contact surface 169-2 of finger 155-2 slides against flat abutment surface 143-2 of locking tang 135-2, fingers 155 continuing to inwardly compress locking tangs 135.

Referring now to FIG. 24(*e*), further forward advancement of anti-tampering device 151 eventually causes fingers 155 to abut against inner surface 127 of top wall 119, thereby precluding further forward advancement of anti-tampering device 151. Simultaneously, as anti-tampering device 151 is advanced forward, each locking tang 135 travels along the entire length of its associated flat contact surface 169. At this point, locking tangs 135 resiliently outwardly displace into their original position, thereby lockably securing anti-tampering device 151 within head 113. Accordingly, upon the application of a rearward withdrawal force on strap 115, second end 175-1 of finger 155-1 would latch against engagement shelf 145-1 and second end 175-2 of finger 155-2 would latch against engagement shelf 145-2, thereby locking anti-tampering device 151 within strap accepting channel 129 so as to preclude removal of strap 115 from head 113, which is highly desirable.

Figure 25:
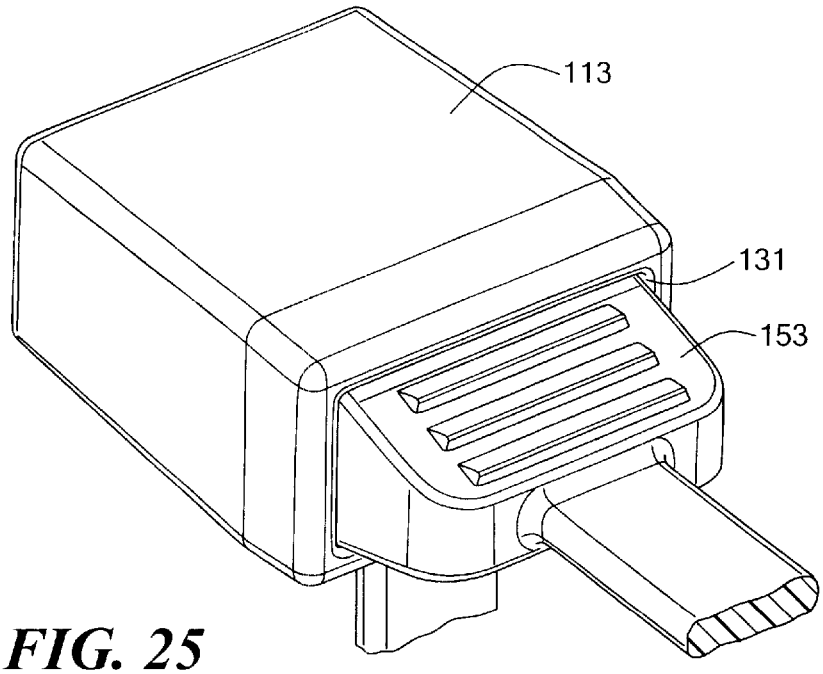
FIG. 25 is an enlarged, fragmentary, bottom perspective view of the tie shown in FIG. 15, the tie being shown with the anti-tampering device inserted into the head.

It should be noted that, with anti-tampering device 151 fully inserted into head 113, the particular size and shape of plug 153 serves to substantially enclose entry end 131 of strap accepting channel 129, as shown in FIG. 25. Accordingly, an unscrupulous person is precluded from tampering with locking tangs 135 through entry end 131, which is highly desirable.

Figure 26:
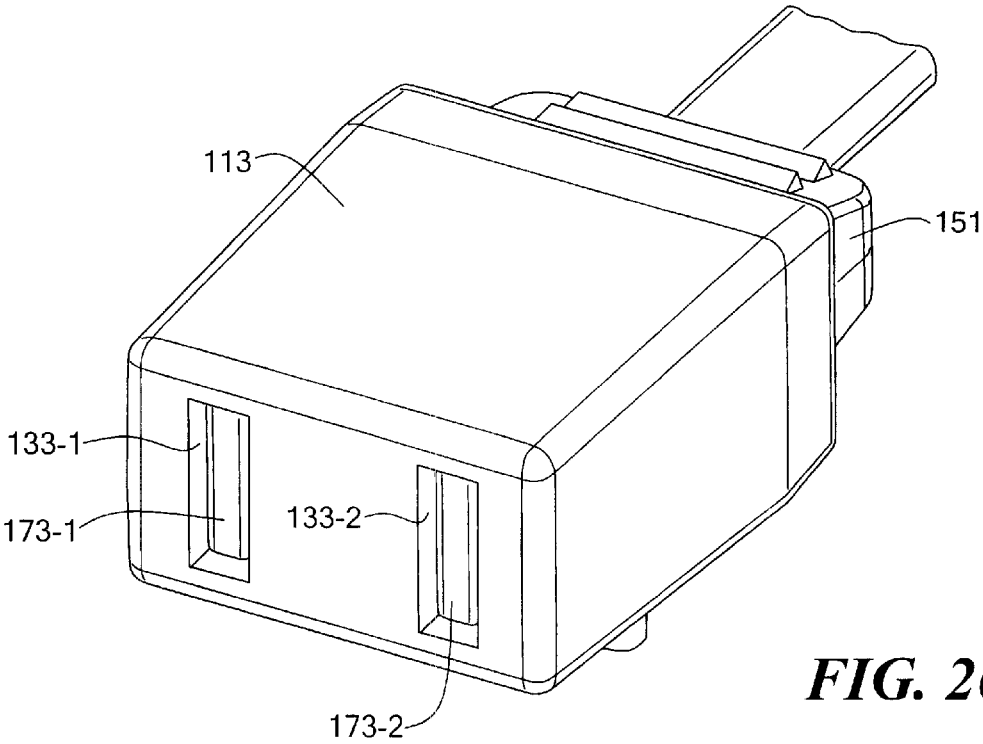
FIG. 26 is an enlarged, fragmentary, top perspective view of the tie shown in FIG. 15, the tie being shown with the anti-tampering device inserted into the head.

It should also be noted that, with anti-tampering device 151 fully inserted into head 113, the particular size and shape of first end 173-1 of finger 155-1 serves to substantially enclose exit end 133-1 and the particular size and shape of first end 173-2 of finger 155-2 serves to substantially enclose exit end 133-2, as shown in FIG. 26. Accordingly, an unscrupulous person is precluded from tampering with locking tangs 135 through exit ends 133, which is highly desirable.

It should be further noted that, with anti-tampering device 151 fully inserted into head 113, first end 173 of fingers 155 is disposed flush against, or slightly in from, outer surface 128 of top wall 119, which is highly desirable. Specifically, it has been found to be desirable to retain first end 173 of fingers 155 within head 113 to prevent the inadvertent catching or scraping of strap 115 against an item.

It should be noted that the dual locking tang design of tie 111 provides tie 111 with two principle advantages over single locking tang tie 11.

As a first advantage, the dual locking tang construction of tie 111 serves to significantly increase the retentive force of anti-tampering device 151 within head 113 when tie 111 is formed into a closed loop, thereby ensuring that tie 111 remains in its closed loop configuration even upon the application of a considerable withdrawal force. Accordingly, tie 111 is desirable for use in high strength, increased security applications.

As a second advantage, the dual locking tang construction of tie 111 serves to significantly increase the security of tie 111. Specifically, the particular construction of tie 111 requires an unscrupulous person to simultaneously tamper with both locking tangs 135 in order to release tie 111 from its closed loop configuration.

In addition, it should be noted that, although tie 111 is shown as having a dual locking tang construction, it is to be understood that tie 111 could be modified to include more than two locking tangs to increase its overall strength and security without departing from the spirit of the present invention.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A tie molded as a single piece, said tie comprising:

(a) a head shaped to include an elongated strap accepting channel therethrough, the strap accepting channel having a longitudinal axis, a strap entry end and a strap exit end, said head comprising an articulating locking tang which is disposed to project into the strap accepting channel, and (b) a strap having a first end and a second end, the first end being formed onto said head, said strap being sized and shaped to be inserted into the strap accepting channel so said tie forms a closed loop, said strap including an anti-tampering device which is adapted to be engaged by the locking tang when said tie is formed into a closed loop, said anti-tampering device being sized and shaped to substantially enclose the strap entry end and the strap exit end of the strap accepting channel when said tie is formed into a closed loop.

2. The tie as claimed in claim 1 wherein the anti-tampering device is formed onto the second end of said strap.

3. The tie as claimed in claim 1 wherein said anti-tampering device comprises, (a) a plug sized and shaped to substantially enclose the entry end of the strap accepting channel when said tie is formed into a closed loop, and (b) a finger sized and shaped to substantially enclose the exit end of the strap accepting channel when said tie is formed into a closed loop.

4. The tie as claimed in claim 3 wherein said finger includes a flat top surface, a bottom surface, a first end and a second end, the first end being sized and shaped to project into and substantially enclose the exit end of the strap accepting channel when said tie is formed into a closed loop, the second end being sized and shaped to engage the locking tang.

5. The tie as claimed in claim 3 wherein, with said tie formed into a closed loop, the plug of said anti-tampering device at least partially projects into the strap accepting channel.

6. The tie as claimed in claim 1 wherein the locking tang is in the form of an elongated arm which includes a first end and a second end.

7. The tie as claimed in claim 6 wherein the second end of the locking tang is in the form of an enlarged head which includes a beveled surface, a flat abutment surface and an engagement shelf.

8. A tie comprising:

(a) a head shaped to include an elongated interior channel therethrough, the interior channel having a longitudinal axis, a strap entry end and a strap exit end, said head comprising a locking tang which is disposed to project into the elongated interior channel, the locking tang extending approximately in parallel with the longitudinal axis of the strap accepting channel, and (b) a strap having a first end and a second end, the first end being formed onto said head, said strap being sized and shaped to be inserted into the elongated interior channel so said tie forms a closed loop, said strap including an anti-tampering device which is adapted to be engaged by said head when said tie is formed into a closed loop, said anti-tampering device being sized and shaped to substantially enclose the strap entry end and the strap exit end of the interior channel when said tie is formed into a closed loop.

9. The tie as claimed in claim 8 wherein said head comprises a bottom wall, a top wall, a first sidewall, a second sidewall, an outer end wall and an inner end wall, the locking tang being formed onto the top wall and extending in parallel with the outer end wall and the inner end wall.

10. The tie as claimed in claim 9 wherein the strap entry end is formed into the bottom wall of said head and the strap exit end is formed into the top wall of said head.

11. The tie as claimed in claim 10 wherein the locking tang includes a first end which is formed onto the top wall and a second end which includes a beveled surface, a flat abutment surface and an engagement shelf.

12. A tie comprising:

(a) a head shaped to include an elongated strap accepting channel therethrough, the strap accepting channel having a longitudinal axis, a strap entry end, a first strap exit end and a second strap exit end, and (b) a strap having a first end and a second end, the first end being formed onto said head, said strap being sized and shaped to be inserted into the strap accepting channel so said tie forms a closed loop, said strap including an anti-tampering device which is adapted to be engaged by said head when said tie is formed into a closed loop, said strap being sized and shaped to substantially enclose the strap entry end, the first strap exit end and the second strap exit end when said tie is formed into a closed loop.

13. The tie as claimed in claim 12 wherein said anti-tampering device is sized and shaped to substantially enclose the strap entry end, the first strap exit end and the second strap exit end when said tie is formed into a closed loop.

14. The tie as claimed in claim 13 wherein the anti-tampering device is formed onto the second end of said strap.

15. The tie as claimed in claim 13 wherein said head comprises a first locking tang which is disposed to project into the strap accepting channel and a second locking tang which is disposed to project into the strap accepting channel, said anti-tampering device being adapted to be engaged by the first and second locking tangs when said tie is formed into a closed loop.

16. The tie as claimed in claim 15 wherein said anti-tampering device comprises, (a) a plug sized and shaped to substantially enclose the entry end of the strap accepting channel when said tie is formed into a closed loop, (b) a first finger sized and shaped to substantially enclose the first exit end of the strap accepting channel when said tie is formed into a closed loop, and (c) a second finger sized and shaped to substantially enclose the second exit end of the strap accepting channel when said tie is formed into a closed loop.

17. The tie as claimed in claim 16 wherein said first finger includes a first end and a second end, the first end being sized and shaped to project into and substantially enclose the first exit end of the strap accepting channel when said tie is formed into a closed loop, the second end being sized and shaped to engage the first locking tang.

18. The tie as claimed in claim 17 wherein said second finger includes a first end and a second end, the first end being sized and shaped to project into and substantially enclose the second exit end of the strap accepting channel when said tie is formed into a closed loop, the second end being sized and shaped to engage the second locking tang.

19. The tie as claimed in claim 18 said anti-tampering device is a unitary piece.

* * * * *